US007311742B2

(12) United States Patent
Mori et al.

(10) Patent No.: US 7,311,742 B2
(45) Date of Patent: Dec. 25, 2007

(54) VACUUM CLEANER

(75) Inventors: Hiroshi Mori, Shiga (JP); Toru Odachi, Shiga (JP); Kenichiro Sunaba, Shiga (JP); Tetsuo Imai, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 593 days.

(21) Appl. No.: 10/753,452

(22) Filed: Jan. 9, 2004

(65) Prior Publication Data

US 2004/0143929 A1 Jul. 29, 2004

(51) Int. Cl.
*B01D 45/12* (2006.01)

(52) U.S. Cl. ..... 55/337; 55/343; 55/345; 55/418; 55/426; 55/459.1; 55/459.3; 55/DIG. 3

(58) Field of Classification Search ..... 55/337, 55/343, 345, 426, 459.1, 459.3, DIG. 3, 418; 15/350, 353

See application file for complete search history.

(56) References Cited

U.S. PATENT DOCUMENTS 3,953,184 A * 4/1976 Stockford et al. ..... 55/458
4,593,429 A * 6/1986 Dyson ..... 15/353
6,428,589 B1 * 8/2002 Bair et al. ..... 55/318
6,835,222 B2 * 12/2004 Gammack ..... 55/345

FOREIGN PATENT DOCUMENTS

| | | |
|---|---|---|
| FR | 2808987 | 11/2001 |
| JP | 2001-104223 | 4/2001 |
| JP | 2003-112082 | 4/2003 |
| JP | 2004-159814 | 6/2004 |
| WO | 03/030702 | 4/2003 |

* cited by examiner

*Primary Examiner*—Robert A. Hopkins
(74) *Attorney, Agent, or Firm*—Bacon & Thomas, PLLC

(57) ABSTRACT

An electric vacuum cleaner includes an inlet port through which a suctioned air stream including dirt particles pass and a centrifugal separation member having a substantially circular space therein. The centrifugal separation member has a swirl portion to swirl the dust-laden suction air stream along an inner surface of the centrifugal separation member. By forming swirl passageway between the swirl portion and the inner surface of the centrifugal separation member, the high velocity swirling air stream can be made and consequently an efficiency of separating the dirt particles from the suction air and collecting the dirt particles can be improved.

13 Claims, 7 Drawing Sheets

VACUUM CLEANER

FIELD OF THE INVENTION

The present invention relates to an electric vacuum cleaner; and, more particularly, to a dirt collection structure of an electric vacuum cleaner.

BACKGROUND OF THE INVENTION

Referring to FIG. 7, there is illustrated a conventional electric vacuum cleaner including dirt collection chamber 31 having a bottom surface and air inlet 32 tangentially provided on a side wall of dirt collection chamber 31. Cover 34 is provided to cover upper opening 33 of dirt collection chamber 31 and exhaust port 35 is formed in cover 34. Further, filter 36 is provided to cover upper opening 33 of dirt collection chamber 31. During an operation of electric blower 37, dirt particles are suctioned from suction nozzle 38 and travel into dirt collection chamber 31 via air inlet 32. The dirt particles in the suctioned dirt-laden air stream are centrifugally separated in dirt collection chamber 31, and the dirt-free air stream is exhausted through exhaust port 35 via filter 36 (see Japanese Patent Laid-open Publication No. 2001-104223).

Under such arrangement, however, the dirt particles collected in dirt collection chamber 31 via air inlet 32 adhere to filter 36, resulting in a significant disturbance of the suction flow, which in turn significantly reduces the overall suction force. In an attempt to solve such problem, filter 36 of an enlarged filtering area has been tried. However, such enlarged filter entails a problem of increasing the size of dirt collection chamber 31 and consequently increasing the overall size of the vacuum cleaner itself.

SUMMARY OF THE INVENTION

It is, therefore, an object of the present invention to provide a vacuum cleaner capable of maintaining suction performance thereof by preventing deterioration of a suctioning force without increasing the size thereof.

In accordance with one aspect embodiment of the present invention, there is provided an electric vacuum cleaner including:

a centrifugal separation member having a substantially circular space and including an inlet port through which a suctioned dirt-laden air stream is supplied, wherein the centrifugal separation member further includes therein a swirl portion allowing the suctioned dirt-laden air stream to swirl along an inner surface of the centrifugal separation member.

In accordance with another aspect embodiment of the present invention, there is provided an electric vacuum cleaner including:

an electric blower for generating a suction air stream;

a dirt separation member for separating and collecting therein dirt particles from the suction air stream; and a centrifugal separation member for centrifugally separating remaining dirt particles from a suctioned air stream that has passed through the dirt separation member, the centrifugal separation member being disposed in the dirt separation member, wherein the dirt separation member is provided at a bottom portion thereof with a communication aperture in communication with the electric blower.

In accordance with still another aspect embodiment of the present invention, there is provided an electric vacuum cleaner including:

an electric blower for generating a suction air stream;

a dirt separation member for separating and collecting therein dirt particles from the suction air stream; and a centrifugal separation member for centrifugally separating remaining dirt particles from a suctioned air stream that has passed through the dirt separation member, the centrifugal separation member being disposed in the dirt separation member, wherein the centrifugal separation member has an inlet port into which the remaining dirt particles and the suctioned air stream are introduced; and an air stream guide portion provided near the inlet port to direct the suctioned air stream thereto.

In accordance with still another aspect embodiment of the present invention, there is provided an electric vacuum cleaner including:

an electric blower for generating a suction air stream;

a dirt separation member for separating and trapping therein dirt particles from the suction air stream; and a centrifugal separation member for centrifugally separating remaining dirt particles from a suctioned air stream that has passed through the dirt separation member, the centrifugal separation member being detachably disposed in the dirt separation member, wherein the centrifugal separation member has an inlet port into which the remaining dirt particles and the suctioned air stream are introduced and a dirt removing portion substantially in contact with the inlet port when the centrifugal separation member is detached from the dirt separation member, the dirt removing portion being installed on an inner surface of the dirt separation member.

In accordance with still another aspect embodiment of the present invention, there is provided an electric vacuum cleaner including:

an electric blower for generating a suction air stream;

a dirt separation member for separating and collecting therein dirt particles from the suction air stream;

a centrifugal separation member for centrifugally separating remaining dirt particles from a suctioned air stream that has passed through the dirt separation member, the centrifugal separation member being detachably disposed in the dirt separation member; and a dirt receptacle for accumulating therein the remaining dirt particles centrifugally separated by the centrifugal separation member, the dirt receptacle being integrally formed on the centrifugal separation member, wherein the dirt receptacle has an opening, the opening being blocked by the dirt separation member when the centrifugal separation member is placed in the dirt separation member.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF PREFERRED EMBODIMENTS

A preferred embodiment of the present invention will now be described with reference to FIGS. 1 to 6.

Figure 1:
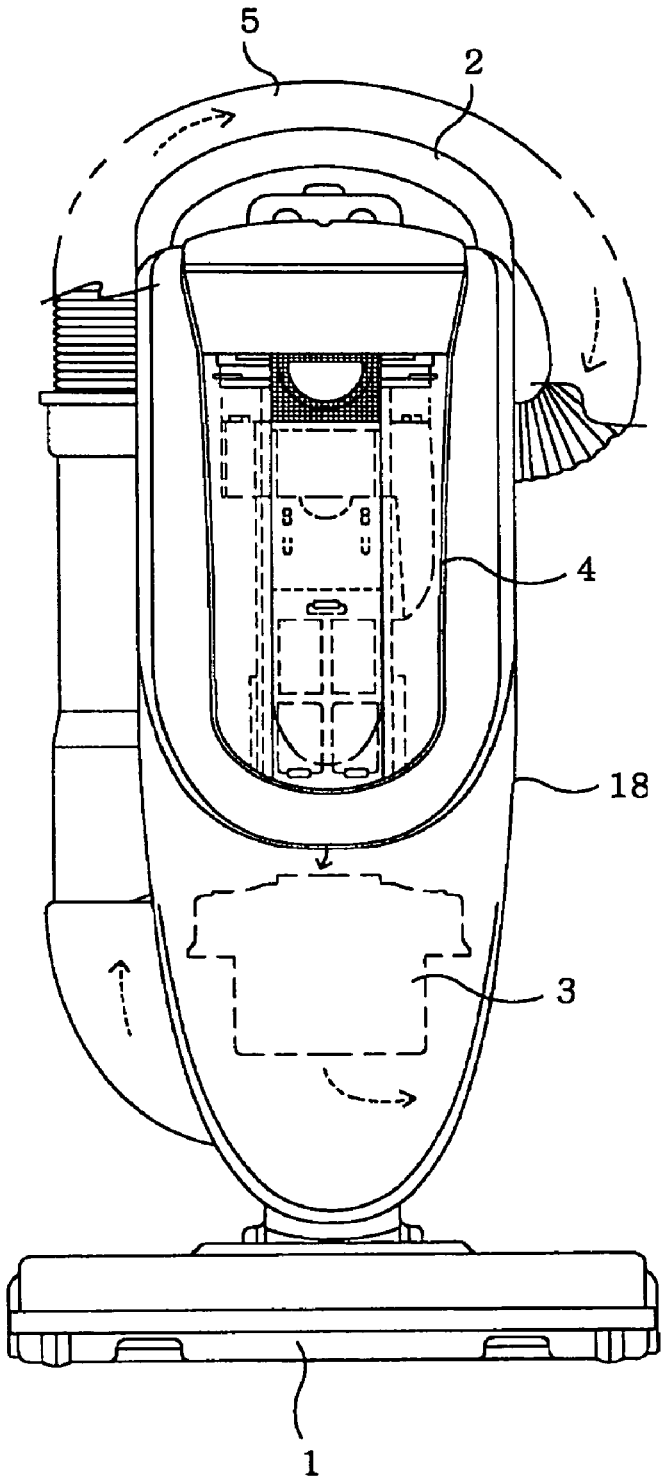
FIG. 1 is a front view of an electric vacuum cleaner in accordance with a preferred embodiment of the present invention.

FIG. 1 is a front view of an electric vacuum cleaner in accordance with the preferred embodiment of the present invention. The vacuum cleaner includes suction nozzle 1 through which dirt particles on a surface to be cleaned are suctioned; main body 18 having therein electric blower 3 for creating a suction air stream; handle 2 having a grip portion in an upper portion of main body 18; a dirt collection unit 4, detachably mounted to main body 18, for collecting therein dirt particles; and hose 5 fixed to handle 2, wherein hose 5 communicating with suction nozzle 1 and dirt collection unit 4 provides a suction air stream pathway therebetween. Further provided in main body 18 is an exhaust port (not shown) for discharging an exhaust air stream generated by electric blower 3.

Figure 2:
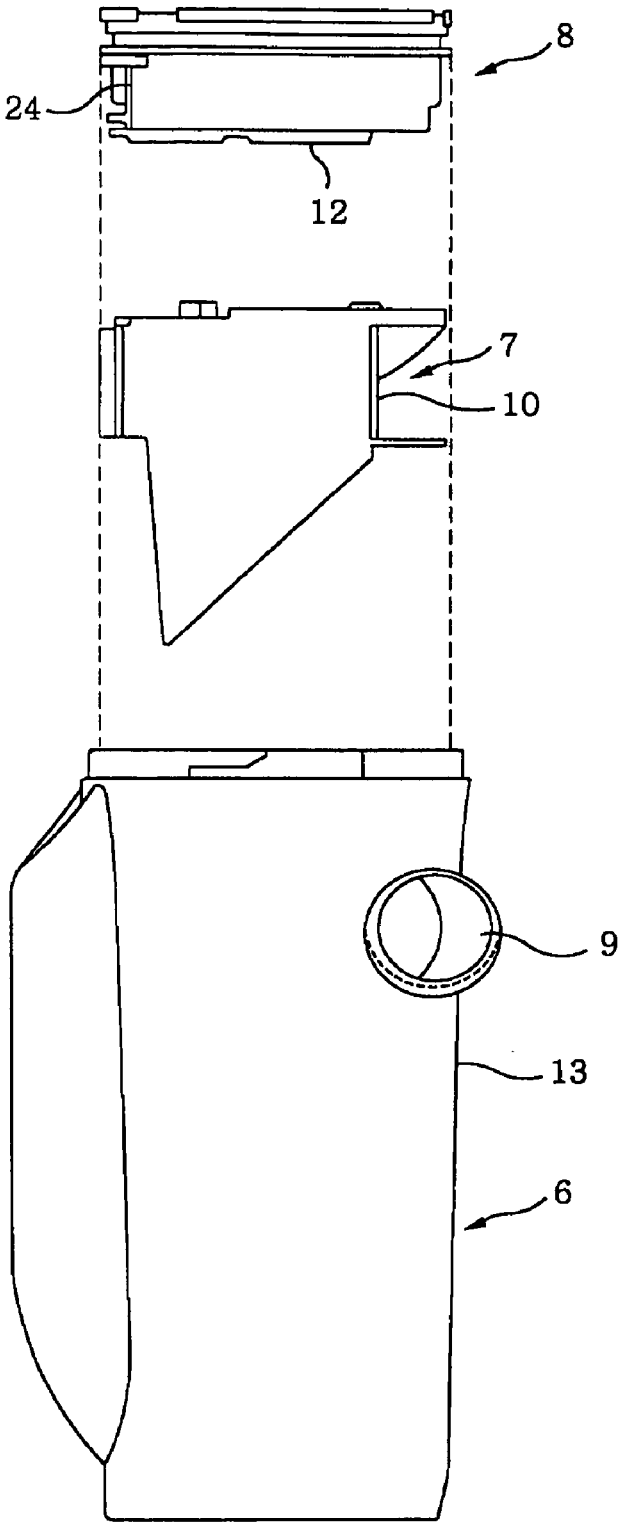
FIG. 2 provides a schematic exploded view of a dirt collection unit of the electric vacuum cleaner.

Referring to FIG. 2, there is illustrated detachably installed dirt collection unit 4 including dirt separation member 6, centrifugal separation member 7 and unit cover 8, which can be respectively installed and detached by turning clockwise and counterclockwise. Specifically, dirt separation member 6 has a bottom portion and wall portion 13 of an approximately cylindrical shape. Further, first inlet port 9 into which a dirt-laden air stream flows from suction nozzle 1 via hose 5 is provided at a predetermined location of wall portion 13. First inlet port 9 has an approximately semi-circular shape in order to increase a flow velocity of the air stream.

Centrifugal separation member 7 with a diameter less than that of dirt separation member 6 has a substantially circular space therein, and is installed in dirt separation member 6. Unit cover 8 is of an approximately cylindrical shape with a soft or elastic material such as elastomer provided on an outer periphery portion thereof. An outer diameter of the soft material is chosen such that the soft material on the outer periphery portion of unit cover 8 is tightly fitted into the inner wall of wall portion 13 of dirt separation member 6.

Reference numeral 12 represents a first communication aperture for allowing a suction port (not shown) of electric blower 3 to communicate with the interior of centrifugal separation member 7 and is covered with a filter. Reference numeral 10 represents a second inlet port through which the dirt-laden air stream is introduced into centrifugal separation member 7. Second inlet port 10 is covered with a filter and positioned not to face first inlet port 9.

Figure 3:
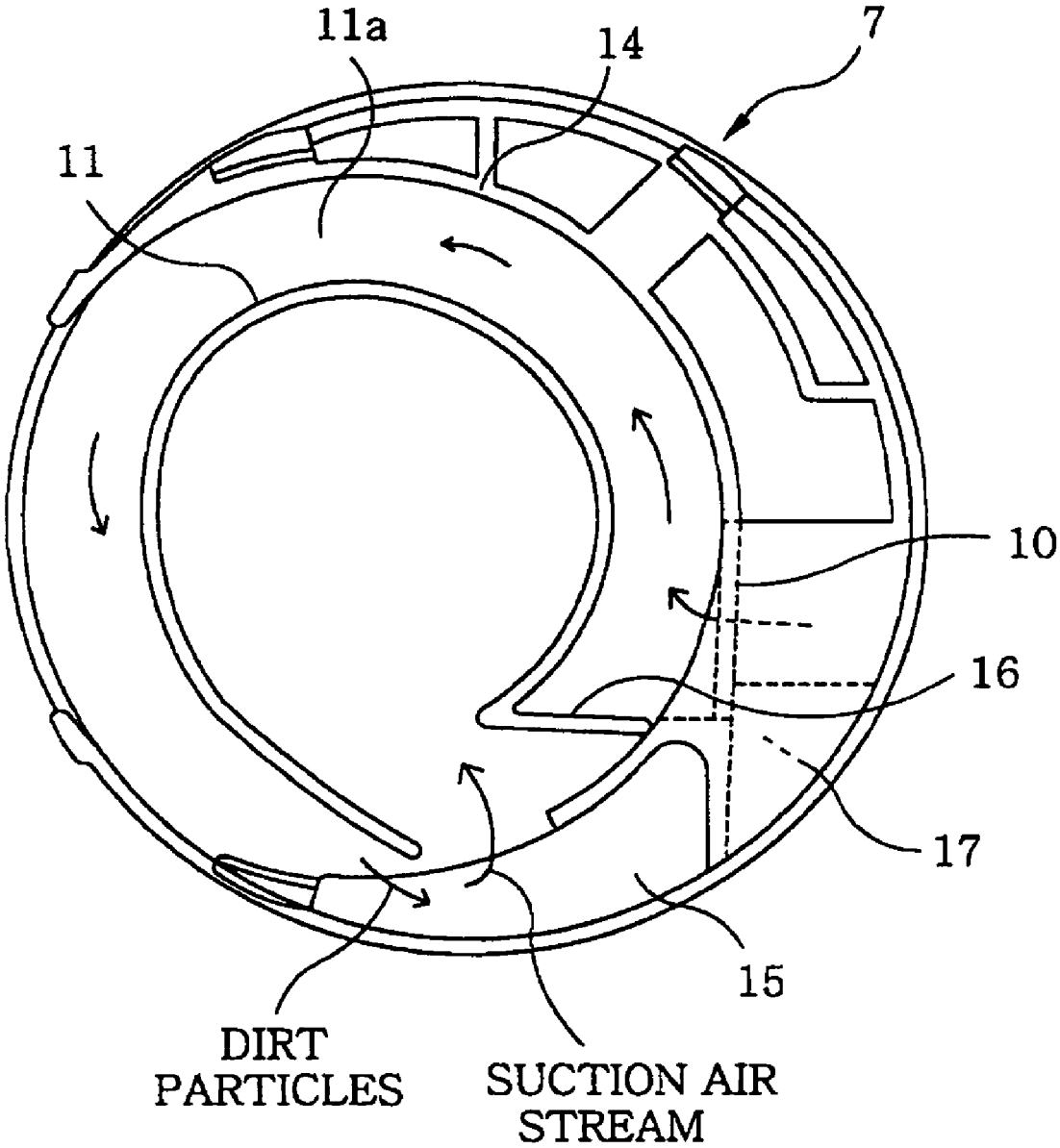
FIG. 3 sets forth a top view of a centrifugal separation member of the dirt collecting unit.
Figure 4:
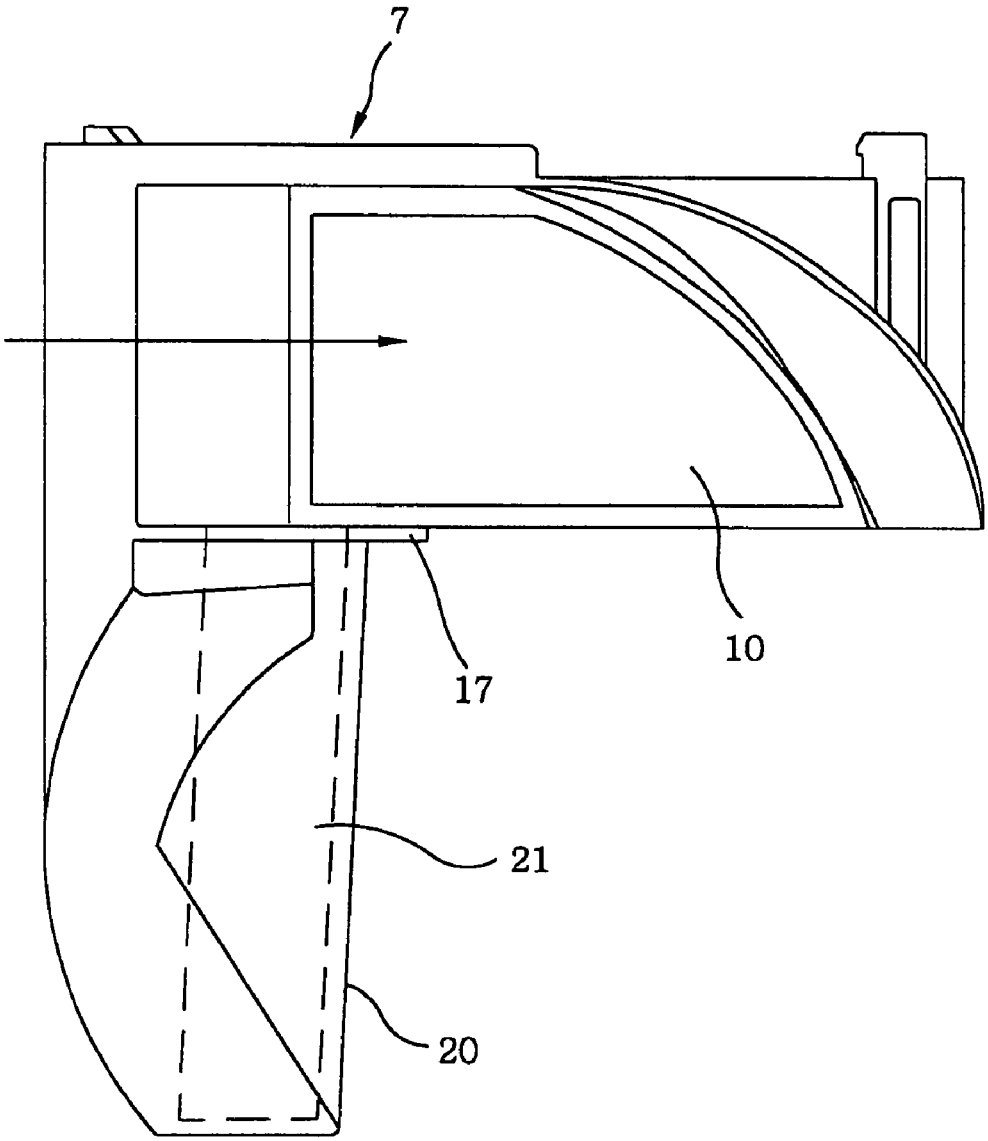
FIG. 4 depicts a side view of the centrifugal separation member of the dirt collection unit.

FIGS. 3 and 4 are a top view and a side view of centrifugal separation member 7 of the electric vacuum cleaner, respectively. Reference numeral 10 is the second inlet port through which the dirt-laden air stream is introduced into centrifugal separation member 7. Reference numeral 14 represents an approximately cylindrical shape wall portion of centrifugal separation member 7, and reference numeral 11 represents a swirl portion of an approximately circular shape disposed inside wall portion 14 of centrifugal separation member 7 to form swirl passageway 11*a* through which the dirt-laden air stream from second inlet port 10 swirls along an inner surface of wall portion 14.

Only an inner side of swirl portion 11 communicates with first communication aperture 12. Reference numeral 15 represents a first opening provided in a bottom part of centrifugal separation member 7. Specifically, first opening 15 is disposed outside swirl portion 11 at a downstream side of swirl passageway 11*a*. Reference numeral 16 represents a guide portion for isolating second inlet port 10 from first opening 15 at an upstream side of the swirling air stream. Specifically, guide portion 16 extends from swirl portion 11 to abut against the inner surface of wall portion 14, so that only the downstream side of swirl passageway 11*a* communicates with first opening 15. Reference numeral 17 represents claw member functioning as an air stream guide portion. Claw member 17 is positioned near second inlet port 10 (below second inlet port 10) to run substantially parallel to a direction of a suctioned dirt-laden air stream having passed through dirt separation member 6. Claw member 17 is capable of efficiently directing the air stream to second inlet port 10 and also serves to remove the dirt particles adhering to second inlet port 10.

Dirt receptacle 20, which communicates with first opening 15, is integrally formed at a bottom portion thereof. Dirt particles separated by centrifugal separation member 7 are accumulated in dirt receptacle 20, which has second opening 21. However, second opening 21 in dirt receptacle 20 is blocked by the inner surface of wall portion 13 of dirt separation member 6 when centrifugal separation member 7 is placed therein.

Figure 5:
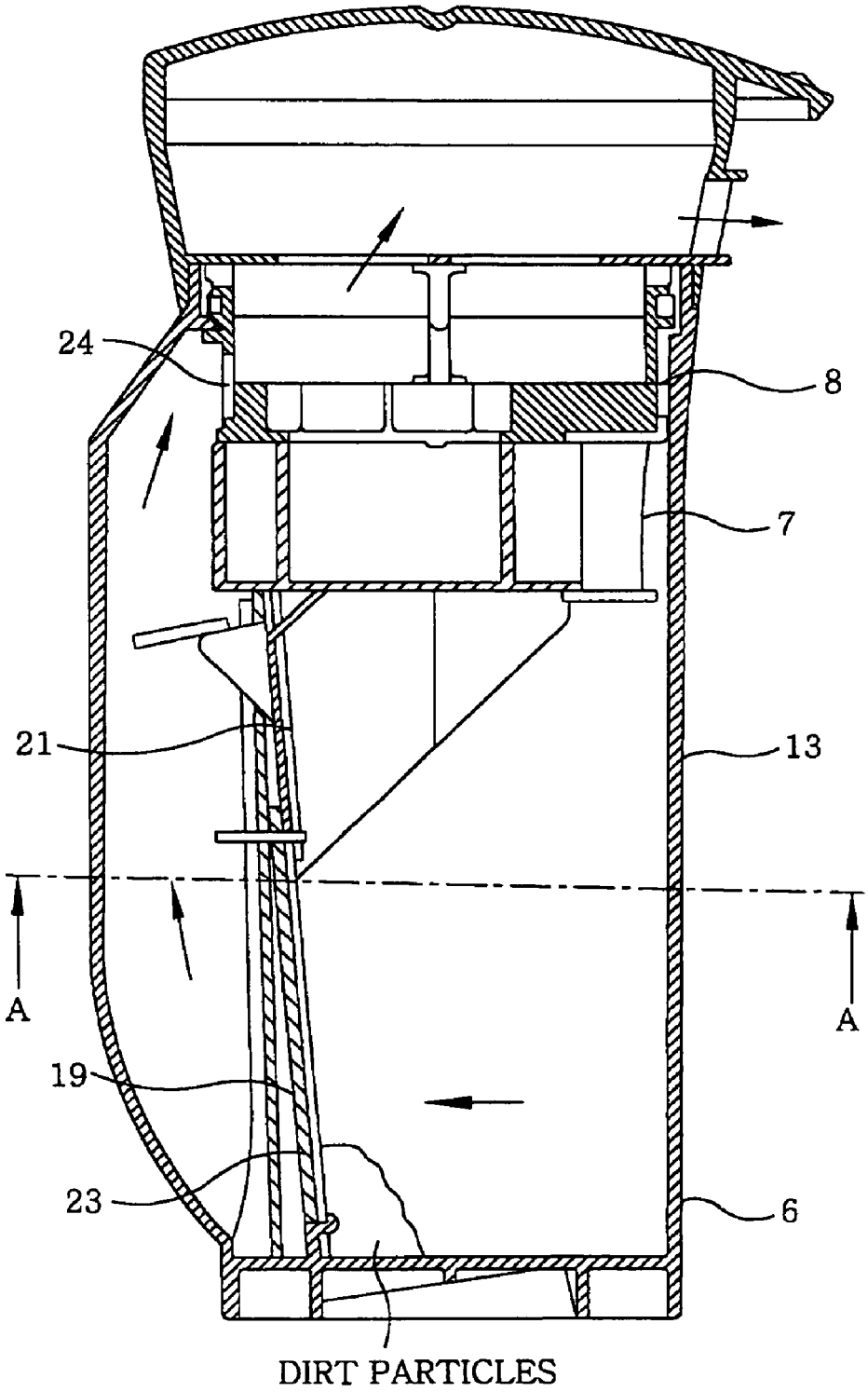
FIG. 5 offers a view of assembled a dirt separation member, the centrifugal separation member and a unit cover.

FIG. 5 is a view of assembled dirt separation member 6, centrifugal separation member 7 and unit cover 8. Reference numeral 19 represents a second communication aperture which enables the suction port (not shown) of electric blower 3 to communicate with the interior of dirt separation member 6. Second communication aperture 19 is located at a bottom portion of dirt separation member 6 (in order to be placed away from centrifugal separation member 7) and covered with filter 23.

Figure 6:
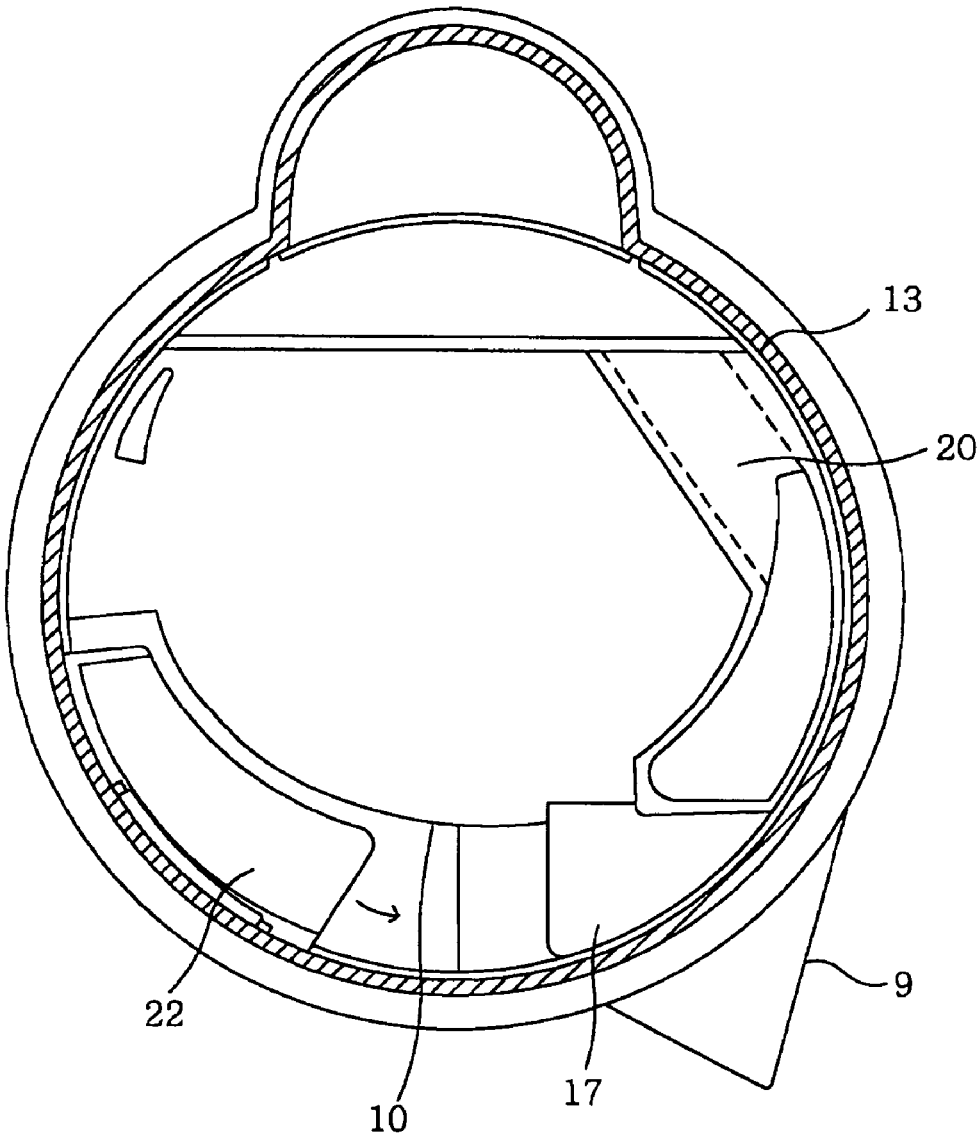
FIG. 6 shows a cross sectional view taken along line A-A in FIG. 5.
Figure 7:
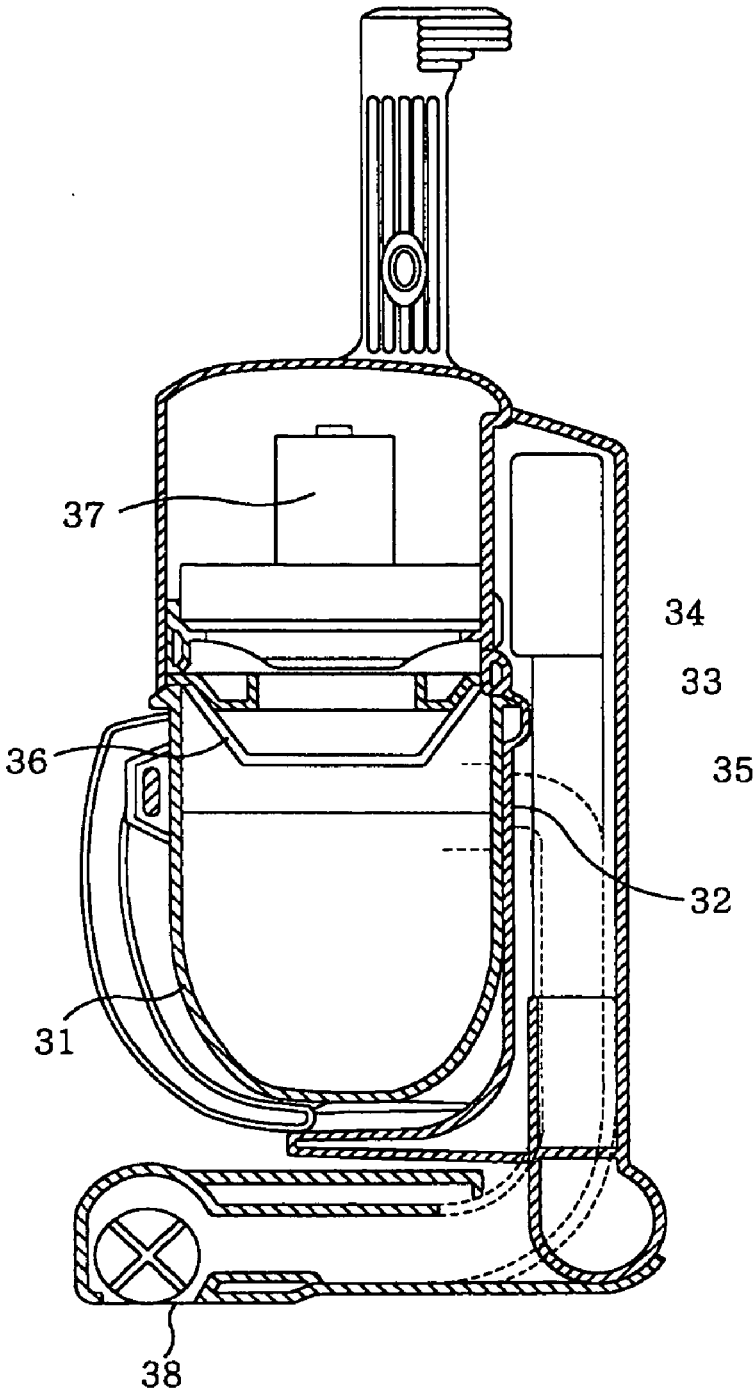
FIG. 7 (PRIOR ART)
FIG. 7 illustrates a schematic view of a conventional electric vacuum cleaner.

FIG. 6 shows a cross sectional view taken along line A-A in FIG. 5. Reference numeral 22 represents a claw member which serves as a dirt particle removing member. Claw member 22 comes in substantial contact with second inlet port 10 when disengaging centrifugal separation member 7 from dirt separation member 6. Specifically, in case of disengaging centrifugal separation member 7 from dirt separation member 6, a locus of claw member 22 is substantially in contact with an outer surface of second inlet port 10.

Operation of the above-described arrangements will now be described in detail. Dirt particles suctioned through suction nozzle 1 travel through hose 5 and then are suctioned into dirt separation member 6 via first inlet port 9. Then, the dirt-laden air stream introduced into dirt separation member 6 via first inlet port 9 collides with wall portion 14 of centrifugal separation member 7.

Dirt particles of great mass are captured in dirt separation member 6, whereas dirt particles of small mass are further suctioned into centrifugal separation member 7 via second inlet port 10. The dirt-laden air stream suctioned into centrifugal separation member 7 centrifugally circulates in swirl passageway 11*a* formed by the inner surface of wall portion 14 and swirl portion 11 of centrifugal separation member 7, respectively. During the course of travel through swirl passageway 11*a*, the dirt particles are separated from the dirt-laden air stream by centrifugal force. The air stream free of dirt travels to an inside of swirl portion 11 via opening provided at the downstream side of swirl passageway 11*a*. Since only the inside of substantially circular swirl portion 11 communicates with the suction port (not shown) of electric blower 3 via fist communication aperture 12, the air stream free of dirt is discharged out of main body 18 via first communication aperture 12. Also, as shown in FIG. 5, an air stream passing through second communication aperture 19 travels via third communication aperture 24 provided in unit cover 8 and is mixed therein with the air stream passing through first communication aperture 12. The mixed air stream is then suctioned into electric blower 3.

The dirt particles separated from the dirt-laden air stream are accumulated in dirt receptacle 20 through first opening 15. Though, dirt receptacle 20 is provided with second opening 21, an airflow is not generated in dirt receptacle 20 since second opening 21 is blocked by the inner surface of wall portion 13 of dirt separation member 6 when centrifugal separation member 7 is placed in dirt separation member 6. Therefore, a reverse flow of the centrifugally separated dirt particles accumulated in dirt receptacle 20 into centrifugal separation member 7 may be prevented. Furthermore, by separating centrifugal separation member 7 and dirt receptacle 20 from dirt separation member 6, second opening 21 becomes uncovered, allowing the dirt particles to fall into dirt separation member 6 therethrough. Thus, the dirt particles captured by centrifugal separation member 7 and those trapped in dirt separation member 6 can be conveniently disposed of at once.

Furthermore, second communication aperture 19 communicates with an inner portion of dirt separation member 6 and the suction port (not shown) of electric blower 3 is located at the bottom portion of dirt separation member 6 (in order to be placed away from centrifugal separation member 7) while being covered with filter 23. Consequently, the dirt particles captured in dirt separation members 6 are accumulated near second communication aperture 19 by a suction force. For such reason, the dirt particles accumulated in dirt separation member 6 are prevented from flying upward and thus are prevented from adhering to the inlet port of centrifugal separation member 7.

Also, claw member 17 is located near second inlet port 10 (below second inlet port 10) approximately parallel to a direction of a suctioned dirt-laden air stream having passed through dirt separation member 6, therefore, claw member 17 functioning as the air stream guide portion can efficiently direct the air stream toward second inlet port 10 and remove the dirt particles clinging to second inlet port 10.

Moreover, dirt particles adhering to second inlet port 10 may be removed when centrifugal separation member 7 is detached from dirt separation member 6, since a locus of claw member 22 provided on an inner wall of wall portion 13 of dirt separation member 6 is substantially in contact with second inlet port 10.

First communication aperture 12 is provided with a first air-permeable filter for preventing fine dirt particles from entering electric blower 3 and second inlet port 10 of centrifugal separation member 7 is provided with a second air-permeable filter for limiting a size of dirt particles suctioned into centrifugal separation member 7. The first filter of first communication aperture 12 has a mesh size equal to or less than that of the second filter of second inlet port 10, such that a pressure loss through the second filter of second inlet port 10 is equal to or less than that through the first filter of first communication aperture 12, to ensure effective suctioning of the dirt particles into centrifugal separation member 7.

Lastly, centrifugal separation member 7 is detachably coupled to unit cover 8, and thus the interior of centrifugal separation member 7 can be easily cleaned. Moreover, such configuration facilitates cleaning of the dirt particles adhering to first communication aperture 12 of unit cover 8. Thus maintenance and cleaning can be facilitated with such configuration.

Although an upright type electric vacuum cleaner is described in this embodiment, it is to be appreciated to those skilled in the art that the above arrangements may be employed in general vacuum cleaners (e.g., canister type vacuum cleaner) regardless of a power supply type or a configuration thereof.

While the invention has been shown and described with respect to the preferred embodiment, it will be understood by those skilled in the art that various changes and modifications may be made without departing from the spirit and scope of the invention as defined in the following claims.

What is claimed is:

1. An electric vacuum cleaner comprising:

an electric blower for generating a suction air stream;

a dirt separation member for separating and collecting therein dirt particles from the suction air stream; and a centrifugal separation member for centrifugally separating remaining dirt particles from a suctioned air stream that has passed through the dirt separation member, the centrifugal separation member being disposed in the dirt separation member, wherein the dirt separation member is provided at a bottom portion thereof with a communication aperture in communication with the electric blower.

2. The electric vacuum cleaner of claim 1, wherein a filter is installed at the communication aperture.

3. The electric vacuum cleaner of claim 1, wherein the centrifugal separation member has an inlet port into which the remaining dirt particles and the suctioned air stream are introduced; and an air stream guide portion provided near the inlet port to direct the suctioned air stream to the inlet port.

4. The electric vacuum cleaner of claim 3, wherein the air stream guide portion runs substantially parallel to a direction of the suctioned air stream having passed through the dirt separation member.

5. An electric vacuum cleaner comprising:

an electric blower for generating a suction air stream;

a dirt separation member, having an inlet opening, for separating and collecting therein dirt particles from the suction air stream introduced thereinto via the inlet opening; and a centrifugal separation member for centrifugally separating remaining dirt particles from a portion of the suction air stream introduced into the dirt separation member, the centrifugal separation member being disposed in the dirt separation member, wherein the centrifugal separation member has an inlet port into which the remaining dirt particles and the portion of the suction air stream are introduced; and an air stream guide portion provided near the inlet port to direct the portion of the suction air stream to the inlet port, and wherein the portion of the suction air stream is suctioned into the electric blower via the centrifugal separation member; and the remaining portion of the suction air stream introduced into dirt separation member is suctioned into the electric blower via a communication aperture of the dirt separation member.

6. The electric vacuum cleaner of claim 5, wherein the air stream guide portion runs substantially parallel to a flow direction of the suction air stream being introduced into the inlet port.

7. The electric vacuum cleaner of claim 5, wherein the communication aperture is provided at a bottom portion of the dirt separation member.

8. An electric vacuum cleaner comprising:

an electric blower for generating a suction air stream;

a dirt separation member for separating and trapping therein dirt particles from the suction air stream; and a centrifugal separation member for centrifugally separating remaining dirt particles from a suctioned air stream that has passed through the dirt separation member, the centrifugal separation member being detachably disposed in the dirt separation member, wherein the centrifugal separation member has an inlet port into which the remaining dirt particles and the suctioned air stream are introduced; and a dirt removing portion is installed on an inner surface of the dirt separation member and is substantially in contact with the inlet port when detaching the centrifugal separation member from the dirt separation member.

9. The electric vacuum cleaner of claim 8, wherein the centrifugal separation member has an inlet port into which the remaining dirt particles and the suctioned air stream are introduced; and an air stream guide portion provided near the inlet port to direct the suctioned air stream to the inlet port.

10. The electric vacuum cleaner of claim 9, wherein the air stream guide portion runs substantially parallel to a direction of the suctioned air stream having passed through the dirt separation member.

11. An electric vacuum cleaner comprising:

an electric blower for generating a suction air stream;

a dirt separation member for separating and collecting therein dirt particles from the suction air stream;

a centrifugal separation member for centrifugally separating remaining dirt particles from a suctioned air stream that has passed through the dirt separation member, the centrifugal separation member being detachably disposed in the dirt separation member; and a dirt receptacle for accumulating therein the remaining dirt particles centrifugally separated by the centrifugal separation member, the dirt receptacle being integrally formed on the centrifugal separation member, wherein the dirt receptacle has an opening, the opening being blocked by the dirt separation member when the centrifugal separation member is placed in the dirt separation member.

12. The electric vacuum cleaner of claim 11, wherein the centrifugal separation member has an inlet port into which the remaining dirt particles and the suctioned air stream are introduced; and an air stream guide portion provided near the inlet port to direct the suctioned air stream to the inlet port.

13. The electric vacuum cleaner of claim 12, wherein the air stream guide portion runs substantially parallel to a direction of the suctioned air stream having passed through the dirt separation member.

* * * * *